United States Patent [19]

Ezaki et al.

[11] 3,963,815

[45] June 15, 1976

[54] METHOD OF LINING MOLTEN METAL VESSELS AND SPOUTS WITH REFRACTORIES

[75] Inventors: Toshiyuki Ezaki; Kunio Furukawa, both of Kagogawa; Yasushige Enomoto, Himeji, all of Japan

[73] Assignees: Nippon Steel Corporation, Tokyo; Harima Refractory Co., Ltd., both of Japan

[22] Filed: June 20, 1974

[21] Appl. No.: 481,319

Related U.S. Application Data

[63] Continuation of Ser. No. 269,425, July 6, 1972, abandoned.

[30] Foreign Application Priority Data

July 10, 1971 Japan ..... 46-51263

[52] U.S. Cl. ..... 264/30; 264/71

[51] Int. Cl.[2] ..... F27D 1/16

[58] Field of Search ..... 264/30, 71, 72, 23

[56] References Cited

UNITED STATES PATENTS

| | | | |
|---|---|---|---|
| 1,937,028 | 11/1933 | Lux | 264/72 |
| 2,057,466 | 10/1936 | Willetts | 264/71 |
| 3,637,171 | 1/1972 | Kroeger | 264/30 X |
| 3,637,412 | 1/1972 | Felice | 264/30 X |
| 3,716,316 | 2/1973 | Dekker | 264/30 X |

*Primary Examiner*—Robert F. White
*Assistant Examiner*—Thomas P. Pavelko
*Attorney, Agent, or Firm*—Toren, McGeady and Stanger

[57] ABSTRACT

A method of lining molten metal vessels and spouts with refractories, characterized in that refractories having adjusted grain size are thrown in the outer frame of a top opened vessels and spouts for molten metal and an inner molding frame for lining, which is provided with a vibrator and able to be imposed with loads, is mounted on said refractories and settled down to the prescribed position in the outer frame while vibrated and loaded, so that the internal circumference of the beforementioned outer frame can be lined with the refractories.

1 Claim, 2 Drawing Figures

METHOD OF LINING MOLTEN METAL VESSELS AND SPOUTS WITH REFRACTORIES

Figure 1:
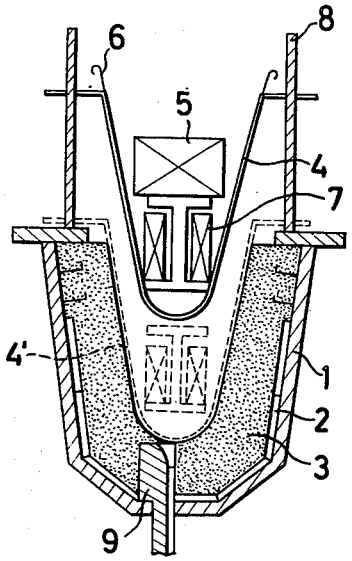

This is a continuation of application Ser. No. 269,425, filed July 6, 1972, now abandoned.

The present invention relates to a method of lining molten metal vessels and spouts with refractories, and, more particularly, to a lining method wherein refractories having an adjusted grain size, which are previously thrown between the outer frame of a vessel or a spout for molten metal and an inner molding frame for lining, given with vibration and load from above said refractories to be settled down to a prescribed position, so that the internal circumference of the vessel or the spout is lined with the refractories.

The present method can be used on molten vessels, such as, a ladle or a tundish for molten pig iron, molten steel or the like, and as a molten metal spout, such as a spout for flushing or tapping of pig iron and slag from a blast furnace or spout for tapping and flushing of a steel furnace.

A ladle, a tundish and a spout, which are used for making iron and steel, are conventionally lined with refractories by laying bricks, such as as pyrophyllitic, clayey, aluminous and magnesian. Thus, troubles arise, since the life of the lining is influenced by the skillness of the brick layer, because the layout of bricks is hampered by the cure which must be taken, in order to minimize the melting loss of the bricks, caused by penetration of molten metal into a masonry joint, the deterioration of peelingness or the abnormal damages of the base metal, caused by penetration of molten steel, and the like.

Beside the above-mentioned brick-laying method, as a molding method for lining a spout with refractories, there has been adopted a method, in which the refractories are stamped by a rammer. Even by this method, the refractories cannot be sufficiently compacted and the compactness differs between the face, stamped by the rammer, and the interior of the refractories, so that the surface cannot be prevented from cracking. If the refractories are bonded by stamping in several layers in order to eliminate the difference of compactness, the structure is apt to be laminary and peels off from the surface. These defects cause problems, such as, the acceleration of the melting loss by molten metal, or the penetration of the base metal.

Recently there was published a method of molding a brick by vibration and under pressure (Refractories, No. 22, p. 478 – 481, 1970), which stirred keen interest, owing to the labour saving in the brick molding and the possibility of obtaining a better quality than that of the conventional mechanical molding. According to this method, a vibrating plate is provided below a frame for molding a brick and the whole body of the frame is vibrated so that the upper surface of the brick is pressed. However, the brick obtained by molding in a closed frame, does not possess a homogeneous structure.

The present invention has been developed in order to eliminate the above-mentioned various defects in the conventional methods for lining a molten metal vessel and spout with refractories. The technical gist of the invention is a method of lining a molten metal vessel and spout with refractories, comprising that the refractories, adjusted in grain size, are thrown in the upwardly opened outer frame of the molten metal vessel and spout and the inner molding frame for lining, which is provided with a vibrator and able to bear the load, is mounted on said refractories and settled down to the prescribed position in the outer frame while it is given vibration and load, and then taken off, so that the internal circumference of said outer frame can be lined with refractories.

The method of the present invention shall be explained in detail, as follows:

The molten metal vessel, mentioned in the present invention, namely a ladle comprises a top opened cup-like iron shell lined with refractories of, say, about 1470 mm in height, 1140 mm in inside diameter at the bottom part and 1540 mm in inside diameter at the upper part; or about 3285 mm in height, 2650 mm in inside diameter at the bottom and 2915 mm at the upper part.

One example of the tundish, mentioned in the present invention, is a top opened iron shell, and for example, a box-shaped iron shell of about 1400 mm in height, 8000 mm in length, 600 mm in width at the bottom part and 800 mm in width at the upper part. Said iron shell is lined with refractories on its inside and serves the function of the outer frame.

The inner molding frame for lining with refractories is made of ordinary steel in such a shape that the refractories, thrown in the above-mentioned outer frame, are filled for molding in the prescribed space between both frames, so that there can be obtained a part, having a U or ⊔-shape in section for a basin of molten iron or steel. The above-mentioned inner molding frame for lining with refractories is made smaller than the above-mentioned outer frame. The thickness of refractories to be lined and the sectional shape of the basin part of molten iron or steel can be suitably determined according to the sectional shape of said inner frame and the position, at which the same is settled down.

The outer frame of the molten metal spout, mentioned in the present invention, comprises an upwardly opened iron shell or refractories, and is such as the outer frame of a fixed spout, embedded immovably before a blast furnace, the exchangeable outer frame of a replaceable spout, or the outer frame of a spout, set aside after use and having another exchangeable outer frame embedded in the fixed spout. In an example of the fixed spout, the outer frame is constructed of a side wall metal and refractories to be lined, in a ⊔-sectional shape of 700 mm in height, 800 mm at the bottom and 10,000 mm in length (the width of the upwardly opened part 1300 mm).

The sectional areas of these spouts are determined according to the iron tapping capacity of a blast furnace.

In an example of a replaceable spout, an iron tapping spout before a blast furnace can be lifted up together with an outer frame so as to be replaceably installed at the prescribed position. The outer frame is made of an outer cast iron shell, having a ⊔-shape of 850 mm in height, 1300 mm in width at the bottom, and 3000 mm in length (the width of the upwardly opened part 1500 mm), and lined with fire bricks or castable refractories in about 65 mm.

In an example of a spout to be set aside after use, the advantages of the fixed spout is added to that of the replaceable spout. The outer frame is made of an iron plate, having a ⊔-shape of, say, 650 mm in height, 700 mm in width at the bottom and 1800 mm in length (the width of the upwardly opened part 1200 mm) and lined with fire bricks or castable refractories a thickness of about 65 mm. It is embedded in the fixed spout to be used. This outer frame is usually thrown away after use. The section of the groove, through which molten metal flows in these spouts, can be determined according to the iron tapping capacity of the blast furnace.

When a spout to be replaceable or set aside after use is used according to the present invention, its outer frame may be sometimes not have the fire bricks or castable refractories as a lining.

The inner molding frame for lining is made of ordinary steel in such a groove shape that the refractories, thrown in the above-mentioned outer frame, are filled in the prescribed space between both frames, so that a groove, having a U or ⊔-shape, through which molten iron flows, can be formed. This inner molding frame for lining is made smaller than the above-mentioned outer frame. The prescribed thickness of refractories and the sectional shape of the groove, through which molten iron flows, can be determined according to the cross-sectional shape and the settle-down position of the inner frame.

The vibrator, used according to the present invention, has the frequency of 1500 to 9000 v.p.m. and an amplitude of 0.2 to 3.0 mm at the time of molding. The vibration is conducted through the inner molding frame for lining of the refractories.

The refractories, being subjected to vibration, having the frequency and amplitude within the above-mentioned extent, is in a fluid condition owing to the movement of the particles. The present inventors have through several experiments found the fact that in this case, if the inner molding frame for lining with refractories is not loaded with weight, it was difficult to obtain a refractory lining, having the most suitable homogeneity and a high compactness.

The load, is the total weight of the inner molding frame for lining, the vibrator, and the load of a plummet or anyother mechanical pressure. The load of a plummet or a mechanical pressure may be applied at or after the time the vibration begins. When the inner molding frame for lining is settled down in the refractories, so that a groove for a flow of molten iron or slags, molten steel or slags or, a basin for molten iron, or molten is formed as prescribed, the refractory lining, having the most suitable homogeneity and a high compactness, can be obtained by a load of 1.5 to 12t per $m^3$ of the volume of the groove or the basin (the volume of the sunken part of the inner frame).

In case of molding under a load of less than 1.5t, the porosity differs remarkably between the upper part and the lower part of the refractories, so that a homogeneous structure cannot be obtained. In case of the load of larger than 12t, the inner frame goes down rapidly at the beginning. The effect, expected under the pressure in a gradual sinking, may be weakened and it becomes difficult to get a homogeneous structure. The refractories may be crushed and the particles are pulverized. Not only can a high compactness not be obtained, but also it becomes unfavorably necessary to enlarge the strength and workability of the outer and inner frames or the load of the vibrator.

The refractories, used according to the present invention for a molten metal vessel, namely, a ladle and a tundish, may include silica, pyrophyllite, chamotte, mullite, alumina, magnesia utilized as the aggregates, and silica, pyrophyllite, chamotte, zircon, alumina, silicon carbide, and magnesia as the matrix. For a spout, there are used, for example, silica, pyrophyllite, chamotte, mullite, silicon carbide as the aggregates, and silica, graphite, carbon, zircon, alumina, silicon carbide and pitch as the matrix. Thus, the materials used must be capable of being set into motion by vibration.

The aggregates are adjusted to 1 to 8 mm in grain size and may be present in an amount from about 30 to 70% by weight. The matrix is adjusted to smaller than 1 mm in grain size and may be present in amounts from 70 to 30% by weight. Further, as the occasion demands, water glass, pulp waste, phosphatic binders and water or tar may be added.

Figure 2:
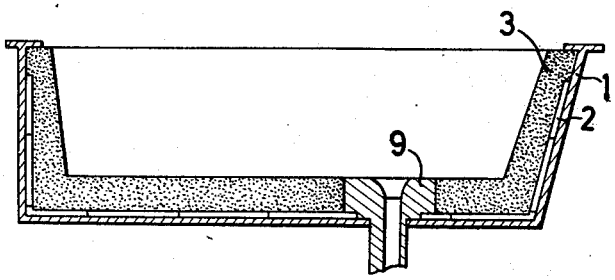

An example of the cae where the present invention is applied to the refractory lining of a tundish for continuous casting, shall be explained referring to the drawings, as follows:

FIG. 1 is a cross section view of an embodiment of a method, by which a tundish for continuous casting is lined with refractories; and FIG. 2, a vertical section view thereof.

In the drawings, 1 is the shell of a tundish. 2 is a brick wall, lined to the outer frame 1. Pyrophyllite bricks or chamotte bricks of about 30 mm thick are usually used. The above-mentioned 1 and 2 serve the function of the outer frame. 3 is a lining layer of refractory, which is filled and molded. 4 is an inner molding frame for lining. Said inner molding frame for lining 4 is so set as to be settled down to the prescribed position along the guide 8, attached to the upper part of the tundish. 5 is a vibrator, installed in the inner molding frame 4; 6, a suspension metal fitting, by which the inner molding frame 4 is carried and attached to or detached from the outer frame 1; 7, a plummet, installed in the inner molding frame 4; and 8, a guide to set the position of the inner frame 4, when the inner frame 4 is settled down in the outer frame 1. The inner molding frame, shown by 4' (a dotted line) is illustrated in the condition that the above-mentioned inner frame 4 is settled down at the prescribed position of the refractories 3. 9 is a tuyere nozzle.

The operation shall be explained for lining the tundish with refractories by mean of the refractory lining device, constructed as above. First, the brick wall 2 is placed for lining. The prescribed quantity of refractories 3, adjusted in grain size, is thrown in the outer frame 1, in which there is installed the tuyere nozzle 9, having a patch plate attached on the surface.

Then, the inner frame 4, in which the vibrator 5 and the plummets 7 are installed, is mounted on the refractories 3 and the vibration is started. At this time, the frequency is 1500 to 9000 v.p.m. and the amplitude is 0.2 to 3.0 mm. The refractories 3 being to be swayed by the above-mentioned vibration. The inner frame 4 goes down gradually to the prescribed position. The above-mentioned inner frame 4 is vibrated in the loaded condition. Therefore, the refractories 3 in the outer frame 1 are given with an uniform pressure for molding, so that the lining can be achieved with an uniform compactness. When the above molding for lining is finished, the vibration is stopped. The inner frame 4 is pulled out and the patch plate of the tuyere 9 is taken away. The above-mentioned molded part for lining is dried. Thus, the refractory lining of the tundish is finished.

The tuyere part may be opened to make the tuyere nozzle 9 installed, after the refractories 3 have been lined in the outer frame 1.

Now, the embodiment examples shall be explained in detail, as follows:

EXAMPLE 1

A molten metal ⊔-shaped ladle (1470 mm in height, 1140 mm in diameter at the bottom part, and 1540 mm in inside diameter at the upper part — inside measurement), lined with chamotte bricks in 30 mm thick, was used and poured in with 2500 kg of refractories, blended as shown in Table 1 for Example 1. Over the refractories, an inner frame, having a ⊔-sectional shape, of 1270 mm in height, 800 mm in diameter at the bottom part and 1140 mm in diameter at the upper part, was installed with eight vibrators (six — 7700 v.p.m. and two — 1800 v.p.m. in frequency) and given with vibration for 35 minutes. When the vibration was started, the plummet of 4000 kg was put on the inner frame. (The total weight of the inner frame itself, the vibrators and the plummet - 5000 kg). The amplitude was 1.5 mm. The tuyere was previously installed with the patch plate mounted. The parameters of the refractories after molding for lining were obtained as the results shown in Table I, II.

EXAMPLE 2

A molten metal ⊔-shaped ladle (3285 mm in height, 2650 mm in diameter at the bottom part and 2915 mm in diameter at the upper part - inside measurement), lined with chamotte bricks in 30 mm thick, was used and 6500 kg of refractories were poured in and blended as shown in Table 1 for Example 2. After 30 minutes from the beginning of the vibration, 600 kg of refractories were supplementarily poured in. Over the refractories, an inner frame, having a ⊔-sectional shape, of 3050 mm in height, 2360 mm in diameter at the bottom part and 2615 mm in diameter at the upper part, is installed with twenty vibrators (sixteen - 7200 v.p.m. and four - 3600 v.p.m. in frequency) and were vibrated for 40 minutes. After 10 minutes from the beginning of the vibration, a load of 75000 kg was added to the inner frame by oil pressure. (The total weight of the body of the inner frame, the vibrators and the load - 90000 kg). The amplitude was about 1.5 mm. The tuyere was previously installed with the patch plate mounted. The parameter of the refractories after molding for lining were obtained as the results shown in Table I, II.

When the ladles, lined in accordance with in Examples 1 and 2, were used in practice, no abnormal melting loss beginning at a masonry joint, and resulting peelingoff phenomenon were observed. They were subjected to a smooth and comparatively uniform melting loss. The ladle of Example 1 could bear to receive pig iron 320 times as compared with 280 times in a conventional ladle one. The ladle of Example 2 could bear to receive pig iron 400 times as compared with 350 times for a conventional ladle. Their excellent quality was thus confirmed.

EXAMPLE 3

A molten steel ladle, having the shape and size, shown in Example 1, and lined with alumina silicate bricks which were 30 mm thick, was used and 2800 kg of the refractories, blended as shown in Table 1 for Example 3 were poured in. The quality, obtained by molding under the same condition as that of Example 1 is shown in Table 1, (provided that a load of 5500 kg was given by the plummet after 5 minutes from the beginning of vibration. The body of the inner frame, the vibrators and the plummet amounted to 6500 kg). The vibration was continued for 30 minutes with an amplitude of about 1.5 mm.

300 kg of the before-mentioned mixture was additionally poured in through the upper space between the outer frame and the inner frame during the process of molding.

EXAMPLE 4

A molten steel ladle, having the shape and size, shown in Example 2, and lined with 30 mm thick alumina silicate bricks in, was used and 10,000 kg of refractories, blended as shown in Table 1 for Example 3 were poured in with. After 20 minutes from the beginning of vibration, 2000 kg were supplementally added. The molding was performed under the same condition as that of Example 2. (However, a load of 115,000kg was applied by oil pressure after 10 minutes from the beginning of vibration. The body of the inner frame, the vibrators and the load of oil pressure amounted to 130,000 kg.) The time, during which the vibration was applied, was 45 minutes. The amplitude was about 1.5 mm. The tuyere was previously installed with the blind plate mounted. The parameters of the refractories after molding and the results are shown in Table 1, II.

The molten steel ladles of Examples 3 and 4 were compared in use with a conventional brick-lined ladle. The abnormal melting loss of base metal by break of a masonry joint, was found in the conventional ladle. However, there was no abnormal melting loss of refractories, lined on the ladles of Examples 3 and 4. An excellent anti-corrosiveness result was also found. The ladle of Example 3 could be used 30 times without repair (the conventional one - 25 times on the average). The ladle could be used 25 times still more, when it was repaired by the method of the present invention. The ladle of Example 4 could be used 40 times, while a conventional ladle could be used 35 times.

EXAMPLE 5

The ⊔-shaped iron shell of a tundish (the size of said outer frame: 850 mm in height, 600 mm in width at the bottom part, 850 mm in width at the upper part and 4000 mm in length), lined with 30 mm thick chamotte bricks in, was used and 3700 kg of the refractories, shown in Table 1 for Example 5 were poured in. An inner frame, having a ⊔-sectional shape of 500 mm in height, 250 mm in width at the bottom part, 620 mm in width at the upper part and 3700 mm in length, was installed over the refractories and vibrated for 20 minutes by means of eight vibrators (two - 3600 v.p.m. in frequency, six - 7200 v.p.m. in frequency). The plummets, mounted on the inner frame, were loaded with 2400 kg after 10 minutes from the beginning of vibration (the body of the inner frame, the vibrators and the plummets amounted to 3400 kg). The amplitude was about 1.5 mm. The tuyere was previously installed with a patch plate placed on the upper part thereof.

The parameters of the refractories after molding for lining are as shown in Table 2, II.

EXAMPLE 6

The device, employed in Example 5, was poured with 3700 kg of the refractories of Example 6. The molding for lining was performed under the same condition as that of Example 5. (However, the inner frame was installed with the plummet of 2500 kg after 5 minutes from the beginning of vibration. The body of the inner frame, the vibrators and the plummet amounted to 3500 kg. The time of vibration was 30 minutes.) The result is shown in Table 2, II.

The tundish, having the refractories molded as above-mentioned for lining, and the tundish, having bricks laid by a conventional brick-laying method and applied with a coating material, were compared in use with each other. A very favourable result was obtained in the peeling-off property of the base metal with the tundish, having the refractories lined according to the method of the present invention. Namely, in case of the tundish according to the conventional brick-laying method, the lined bricks are often broken owing to a very bad peeling-off property, caused by the tear of masonry joints when the base metal is taken away. However, the base metal can be easily peeled off in the ladle, applied with the present invention, so that the lined refractories show minimal breakage. Further, an excellent result of anti-corrosiveness is obtained. Both the ladles of Examples 5 and 6 could be used 4 to 5 times without repair and could be used more than 20 times with simple repairs of parts.

EXAMPLE 7 and 8

A replaceable spout having a ⊔-shape was, lined with 65 mm thick chamotte bricks. The inside measurement was 800 mm in height, 700 mm at the bottom, 1100 in width at the upwardly opened part and 2000 mm in length. 2000 kg of the respective refractories, shown in Table 3 for Examples 7 and 8 were poured in. The inner frame, made of ordinary steel of 3.2 mm thick and having a ⊔-shape of the out-side measurement of 500 mm in height, 400 mm at the bottom, 800 mm in width at the upwardly opened part and 2000 mm in length, was mounted over the refractories with four vibrators of 7200 v.p.m. in frequency and two vibrators of 3600 v.p.m. in frequency being installed by mean of I-steel in the frame and was vibrated for 10 minutes. Then, the vibration was stopped for a while. The frame was loaded respectively with a plummet of 5200 kg for Example 7 and 3000 kg for Example 8 (the total weight of the inner frame, the vibrators and the load was, respectively, 6000 kg, and 3800 kg), and vibrated once more for 10 minutes. The inner frame was settled down to the prescribed position. The amplitude was about 2 mm in both Examples 7 and 8. During this process, the refractories were supplementarily loaded with 400 kg in Example 7 and 100 kg in Example 8.

After the vibration was stopped, the load was taken away. 5 minutes after, the inner frame was removed.

In order to prevent a negative pressure on the inner frame and the surface of refractories, lined for molding when the inner frame was removed, the air hole, provided at the bottom part of the inner frame, was opened. The respective parameters of the thus obtained refractories are as shown in Table 3, II.

The spouts of Examples 7 and 8 were used after being dried. About 40,000 t of pig iron could be passed by mean of the spout of Example 7 and about 35,000 t, by mean of the spout of Example 8 at the place of a spout, built by a conventional stamping method, where the maximum amount of about 18000 t of pig iron was passed.

EXAMPLES 9 and 10

The replaceable ladle to be lined was a ⊔-shaped one, lined with in 65 mm thick chamotte bricks. The inside measurement was 685 mm in height, 535 mm at the bottom, 635 mm in width at the upwardly opened part and 1800 mm in length. 950 kg and 600 kg of refractories, shown in Table 3, I for Examples 5 and 6 respectively, were poured in. The inner frame, made of ordinary steel of 3.2 mm thick and having a ⊔-shape of the outside measurement of 450 mm in height, 300 mm at the bottom, 535 mm at the upwardly opened part and 1800 mm in length, was mounted over the refractories with four vibrators of 7200 v.p.m. in frequency being installed by mean of I-steel in the frame and was vibrated for 25 minutes. After 5 minutes from the stop of vibration, the inner frame was taken away.

In Example 5, a plummet of 700 kg was put on after 5 minutes from the beginning of vibration (the body of the inner frame, the vibrators and the plummet amounted to 1000 kg). The amplitude was 1.5 mm.

The plummet in Example 6 was 300 kg (the body of the inner frame, the vibrators and the plummet amounted to 600 kg). The amplitude was 1.5 mm.

The parameters of the respective refractories after molding and the results are shown in Table 3, II.

The spout of Example 9, after drying, was used at the place of a spout, built by a conventional stamping method, where the maximum amount of about 20,000 t of molten iron was normally passed during the life of the spout. About 50,000 t of pig iron could be passed. The spout of Example 10 was used in place of a spout, built and molded by a conventional stamping method, where about 20,000 t of pig iron were passed during the normal life of the spout. 35,000 t of pig iron could be passed.

As described above in detail, when the refractories of a pig iron tapping spout for a blast furnace (a fixed spout, a replaceable spout and a replaceable spout, put aside after use) are molded for lining according to the method of the present invention, a high degree of homogeneousness and a compactness can be obtained. The effect is so great that the life can be extended by about 2.5 times as compared with a spout, built and molded according to a conventional method, and that the quality of the product is not influenced by the skill of the brick layer.

Table 1

| | grain size | Example 1 | Example 2 | Example 3 | Example 4 |
|---|---|---|---|---|---|
| pyrophyllite | 7 – 1 | 50 | 40 | 50 | |
| " | less than 1 | 20 | 40 | 10 | |
| silica | less than 1 | 20 | 20 | 10 | |
| " | less than 0.044 | | | | |
| kaolinite | less than 1 | 10 | | | |
| zircon | less than 0.15 | | | 30 | 60 |
| zircon-alumina cullet | 4 – 1 | | | | 30 |
| " | less than 1 | | | | 10 |

Table 1-continued

| | | grain size | Example 1 | Example 2 | Example 3 | Example 4 |
|---|---|---|---|---|---|---|
| | water glass | | (5) | (5) | (5) | (5) |
| II | after being dried at 110°C | porosity | 19.2 | 16.8 | 16.9 | 17.5 |
| | | apparent specific gravity | 2.57 | 2.60 | 3.07 | 4.35 |
| | | bulk specific gravity | 2.08 | 2.16 | 2.56 | 3.59 |
| | | compressive strength kg/cm² | 120 | 138 | 120 | 250 |
| | residual expansion after burning at 1400°C for 2 hr. % | | +2.68 | +3.12 | +5.60 | +0.25 |

Table 2

| | | grain size | Example 5 weight % | Example 6 weight % |
|---|---|---|---|---|
| I | pyrophyllite | 7 – 1 | 40 | |
| | " | 3.5 – 1 | | 5 |
| | " | less than 1 | 10 | |
| | chamotte | 3 – 1 | | 35 |
| | " | less than 1 | | 30 |
| | zircon flower | | 30 | 30 |
| | silicon carbide | powdery | 20 | |
| | water glass | | (5) | (5) |
| | water | | (5.0) | (3.5) |
| II | after being dried at 110°C | porosity | 20.5 | 17.2 |
| | | apparent specific gravity | 3.17 | 3.02 |
| | | bulk specific gravity | 2.52 | 2.50 |
| | | compressive strength | 187 kg/cm² | 281 kg/cm² |
| | shrinkage after burning at 1400°C for 2 hr. | | +5.9% | +0.4% |

Table 3

| | refractory | grain size mm | Example 7 weight% | Example 8 weight% | Example 9 weight% | Example 10 weight% |
|---|---|---|---|---|---|---|
| I | electrically molten alumina | 8 – 1 | 70 | | | |
| | synthetic mullite | 8 – 1 | | 60 | 50 | |
| | chamotte | 8 – 1 | | | | 70 |
| | silicon carbide | 8 – 1 | | | 10 | |
| | " | less than 1 | | | 30 | 20 |
| | " | 1 – 0.07 | 10 | 20 | | |
| | " | less than 0.07 | 10 | 10 | | |
| | molten silica | less than 0.07 | 5 | 15 | | |
| | silica | less than 0.07 | 5 | | 10 | 10 |
| | metallic silicon | less than 0.07 | | 5 | | |
| | hard pitch | less than 1 | | | (5) | (5) |
| | pulp waste | | (1) | (1) | (1) | (1) |
| | water | | | | (7.0) | (7.0) |
| | after being dried at 110°C | porosity | 20.4% | 20.2% | 19.8% | 20.4% |
| | | apparent specific gravity | 3.38 | 2.82 | 2.82 | 1.86 |
| | | bulk specific gravity | 2.69 | 2.25 | 2.26 | 1.48 |
| II | hot bending 1400°C × 1 hr. kg/cm² | | 28.2 | 52.4 | | |
| | bending strength kg/cm² | after drying 1400°C | | | 25.3<br>45.2 | 23.0<br>9.6 |
| | shrinkage after burning 1450°C × 2 hr. | | | | +0.10 | +0.02 |

What is claimed is:

1. A method for lining metal vessels and spouts to be used for molten metals with refractories comprising the steps of:

A. introducing a particulate refractory material composed of 30% to 70% by weight of aggregate particles having a grain size from 1 to 8 mm and 70% to 30% by weight of matrix particles not larger than 1 mm into the spout or vessel;

B. placing a molding frame having a desired lining profile on the refractory material;

C. subjecting the refractory material to vibration of a frequency from 1500 to 9000 v.p.m. and an amplitude of 0.2 to 3.0 mm to place the refractory in a fluidic state; and D. applying a load of 1.5 to 12 tons per cubic meter based on the volume of the molding frame to the molding frame during said vibration whereby the molding frame settles to a predetermined position to displace a portion of the refractory material which fills the space thus created between the side of the vessel or spout and the molding frame and forms a homogeneous and dense lining.

* * * * *